US006739492B1

(12) United States Patent
Adams et al.

(10) Patent No.: US 6,739,492 B1
(45) Date of Patent: May 25, 2004

(54) STAPLER FOR FORMING STAPLES TO VARIOUS SIZES

(75) Inventors: David P. Adams, Barrington, IL (US); Valentin Fridmanovich, Forest Hills, NY (US); Kenneth John Bargo, Chicago, IL (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/590,283

(22) Filed: Jun. 11, 1999

(51) Int. Cl.[7] ..... B25C 5/04
(52) U.S. Cl. ..... 227/82; 227/88; 227/109
(58) Field of Search ..... 227/86, 91, 93, 227/97, 155, 2, 109, 82, 88

(56) References Cited

U.S. PATENT DOCUMENTS

| | | | | | |
|---|---|---|---|---|---|
| 1,810,528 | A | | 6/1931 | Peterson | |
| 1,996,222 | A | | 4/1935 | Vogel | 1/3 |
| 2,635,234 | A | | 4/1953 | Reed | |
| 2,987,729 | A | | 6/1961 | Taynton | 1/220 |
| 3,347,439 | A | | 10/1967 | Doherty | |
| 3,504,837 | A | | 4/1970 | Cairatti | 227/83 |
| 3,642,187 | A | | 2/1972 | Barland | 227/84 |
| 3,958,738 | A | | 5/1976 | Tremblay | |
| 4,318,555 | A | | 3/1982 | Adamski et al. | 283/7 |
| 4,378,085 | A | * | 3/1983 | McVeigh | 227/79 |
| 4,421,264 | A | * | 12/1983 | Arter et al. | 227/2 |
| 4,583,276 | A | | 4/1986 | Olesen | 29/432.1 |
| 4,693,407 | A | | 9/1987 | Buck et al. | 227/109 |
| 5,004,142 | A | * | 4/1991 | Olesen | 227/155 |
| 5,007,483 | A | | 4/1991 | McGuire | 168/48.1 |
| 5,076,483 | A | * | 12/1991 | Olesen | 227/131 |
| 5,516,025 | A | | 5/1996 | Eriksson | 227/155 |
| 5,931,365 | A | * | 8/1999 | Huang | 227/109 |
| 6,076,720 | A | | 6/2000 | Deng | 227/109 |
| 6,547,230 | B2 | * | 4/2003 | Sato | 270/58.08 |
| 6,557,744 | B2 | * | 5/2003 | Kitamura | 227/119 |

FOREIGN PATENT DOCUMENTS

| | | |
|---|---|---|
| JP | 7-187487 | 7/1996 |

* cited by examiner

*Primary Examiner*—Rinaldi I. Rada
*Assistant Examiner*—Gloria R Weeks
(74) *Attorney, Agent, or Firm*—Michael Best & Friedrich LLP

(57) ABSTRACT

A staple forming mechanism having at least first and second configurations. The staple forming mechanism including a bend surface having a first surface width in the first configuration and a second surface width in the second configuration for forming staples having first and second crown sizes, respectively. The forming mechanism also includes at least two side portions spaced apart by a first former width in the first configuration and by a second former width in the second configuration. The side portions cooperate with the bend surface to form the staples. A stapler includes the forming mechanism and a driver including a driving surface having a first driver width in the first configuration and a second driver width in the second configuration for driving the staples of the first and second crown sizes into a stack of papers. A clinching assembly includes at least one clinching member that is movable along a clinching path to engage a leg of the staple at substantially the same angle regardless of whether the staple is of the first or second crown size.

23 Claims, 15 Drawing Sheets

STAPLER FOR FORMING STAPLES TO VARIOUS SIZES

BACKGROUND OF THE INVENTION

Standard size staples have been used to staple stacks of paper, or other material, within predetermined ranges of stack thicknesses. In general, staples with longer legs are needed to staple thicker stacks than can be stapled with staples that have shorter legs. Standard staple sizes, for example, are configured for stapling ranges of stacks from 2 to 30 sheets or 30 to 70 sheets, for instance.

U.S. Pat. No. 4,318,555 teaches a stapler that cuts and forms staples from a continuous supply of wire. The height of the stack to be stapled is sensed, and the length of the wire to be cut is selected accordingly. The cut blank is then formed into a staple, which is then driven into the sheets to be stapled. As different wire lengths are selected, the staple is formed with legs of varying length, and a crown of a constant length.

U.S. Pat. Nos. 4,583,276 and 5,007,483 show staplers that employ the cartridge that includes a belt of straight, flat staple blank. The belt is fed to a former which bends the blanks to a single size. A driver then drives the formed staple towards an anvil with clinching grooves or clinching wings to bend the staple legs against the stack.

SUMMARY OF THE INVENTION

The invention is related to a stapler that can feed a staple blank of a predetermined length and form the blank into a staple selectably with a smaller or larger crown size, and preferably with corresponding larger or smaller leg length. Thus, a single source of staple blanks can be used to staple a large range of stack sizes, by varying the configuration of the staple produced.

DETAILED DESCRIPTION OF THE PREFERRED EMBODIMENTS

Figure 1:
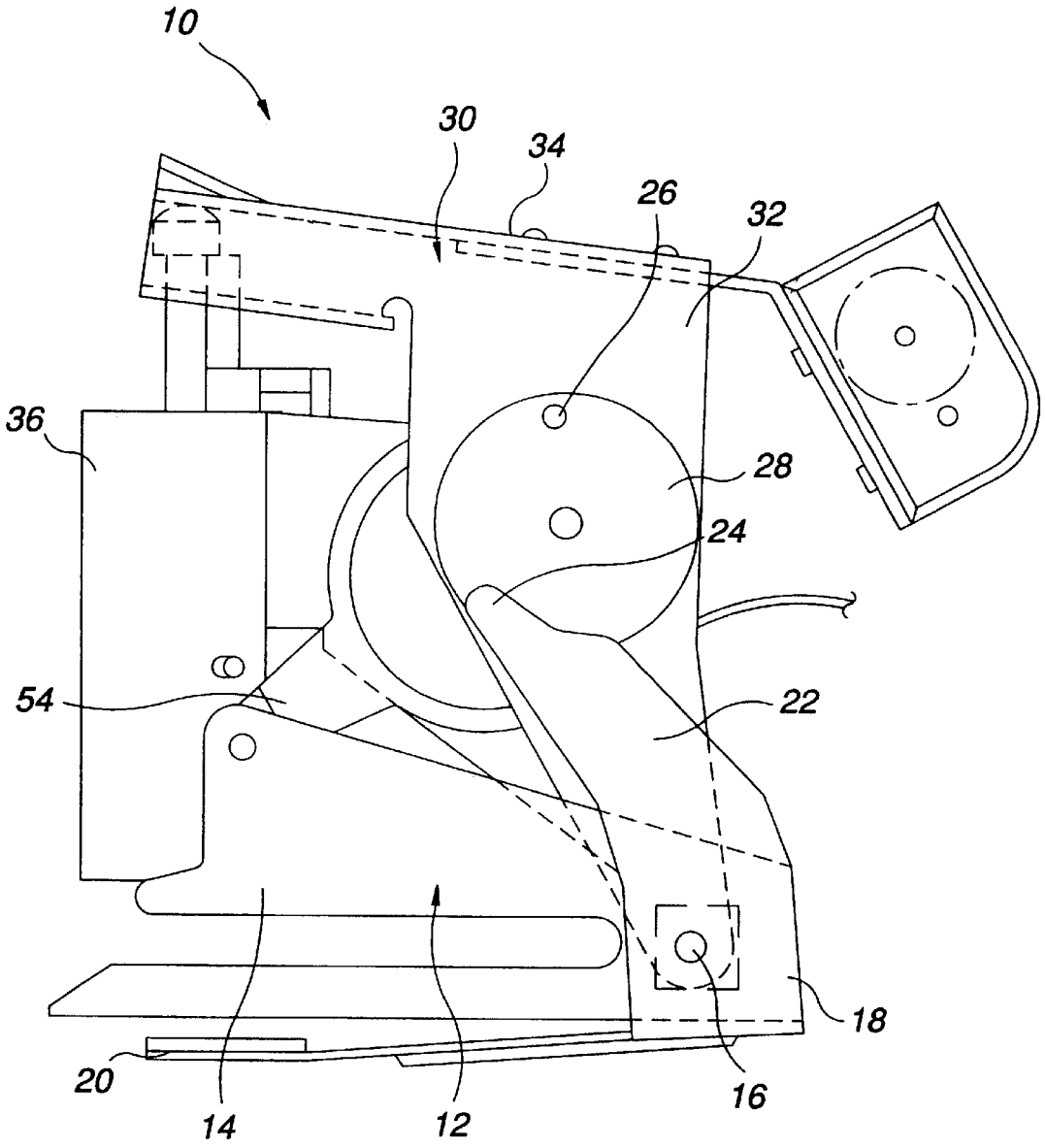
FIG. 1 is a side view of a preferred embodiment of a stapler constructed according to the invention.

Referring to FIG. 1, a preferred embodiment of a stapler 10 constructed according to the invention has a base frame 12 which can be secured to a housing or secured within another apparatus such as a photocopy machine. The frame 12 has side pieces 14, which may be constructed as disclosed in U.S. Pat. No. 5,076,483, which is hereby incorporated by reference. Axle 16 is received in holes in the side pieces, and is preferably held by round clinch washers located in mount recesses of the axle 16. Frame 12 also carries pivotable clinch member actuator 18. Clinch actuator 18 includes a kicker plate 20 and up-standing side pieces 22 with a cam lobe 24 to engage exterior cam pins 26 carried on cam 28 to cause, as explained below, partial rotation upwards and downwards of the actuator unit 18 for actuating clinching members.

Drive control unit 30, also pivotably mounted about axle 16, includes two side frame pieces 32 and a top piece 34. The preferred stapler 10 also has a staple head, also pivotably mounted about axle 16, which houses a driving and forming mechanism.

Figure 2:
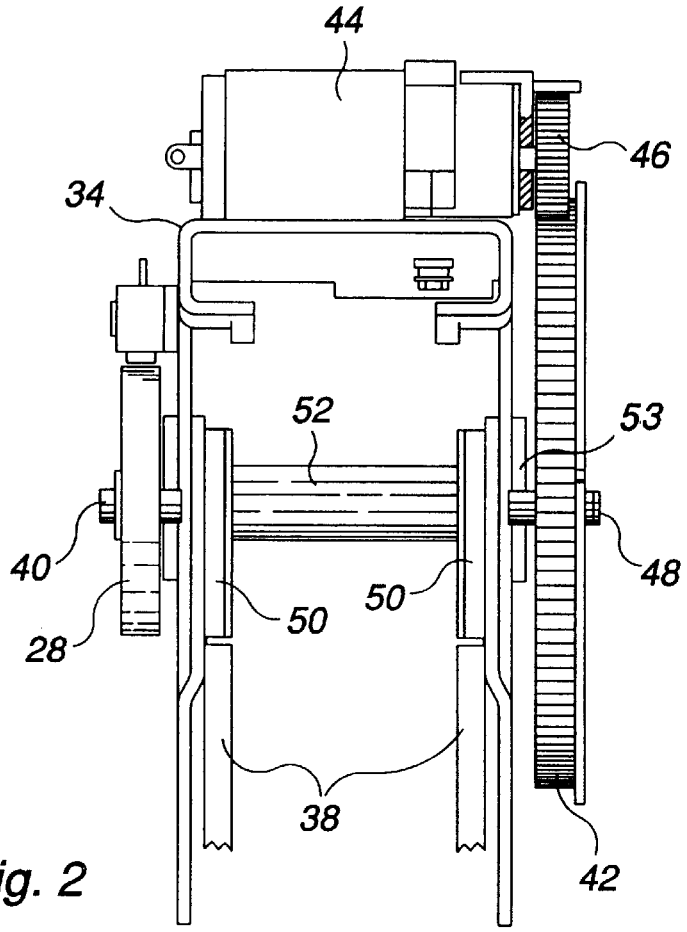
FIG. 2 is a partial top view thereof.
Figure 3:
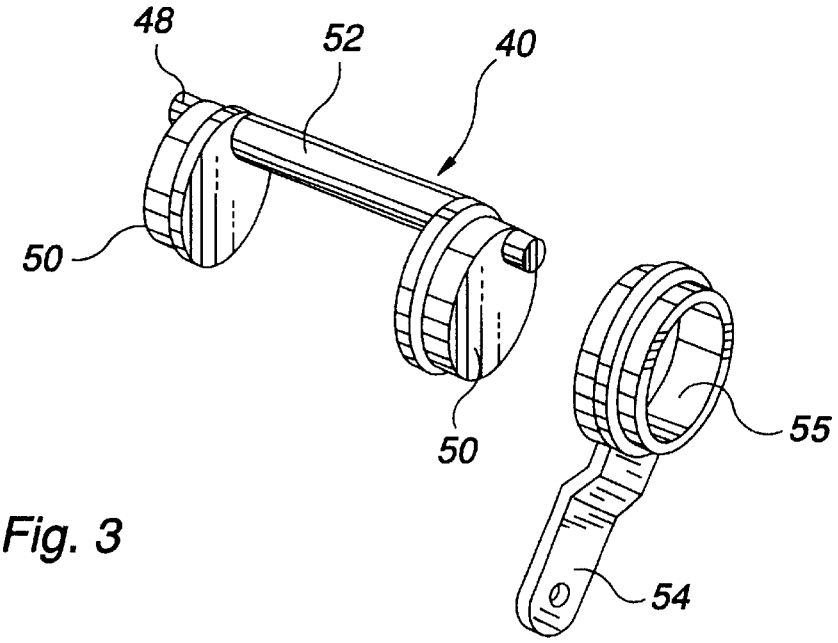
FIG. 3 is an exploded view of part of the actuating mechanism of the stapler.

Referring to FIG. 2, head 36 has two spaced apart sides 38. Drive control unit 30 is driven up and down preferably by a dumbbell-arm eccentric 40, which in turn is rotated by bull gear 42.

A top piece 34 supports motor 44, spur gear 46 and bull gear 42. Dumbbell unit 40 rotates about shaft 48 with disks 50, preferably formed as one integral piece with cross tube 52. One of the disks 50 is preferably interlocked through lock piece 53 to bull gear 42. Cam 28 and the other disk 50 rotate together about the axle 48. Arms 54 have eyelet openings 55 surrounding disks 50. An alternative actuating mechanism, in which arms of the stapling mechanism are driven by a pin engaged in follower slots is shown in U.S. Pat. No. 5,413,266, which is hereby incorporated by reference. Other actuating mechanisms include independent motors or other mechanisms as would be understood by those of ordinary skill in the art.

Figure 4:
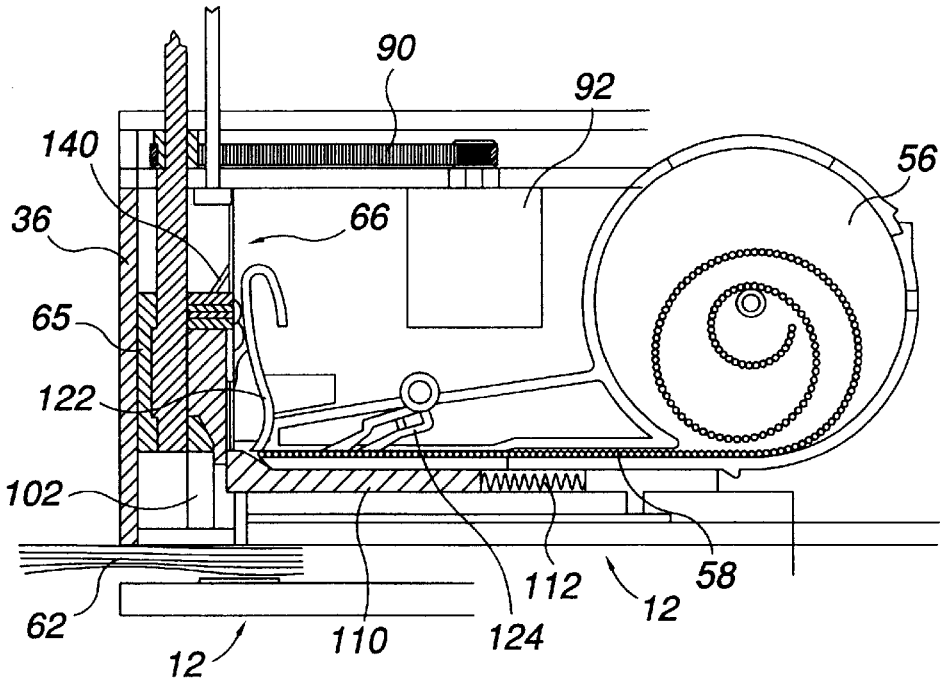
FIGS. 4 and 5 are side cross-sectional views of former/driver assemblies of the stapler.
Figure 5:
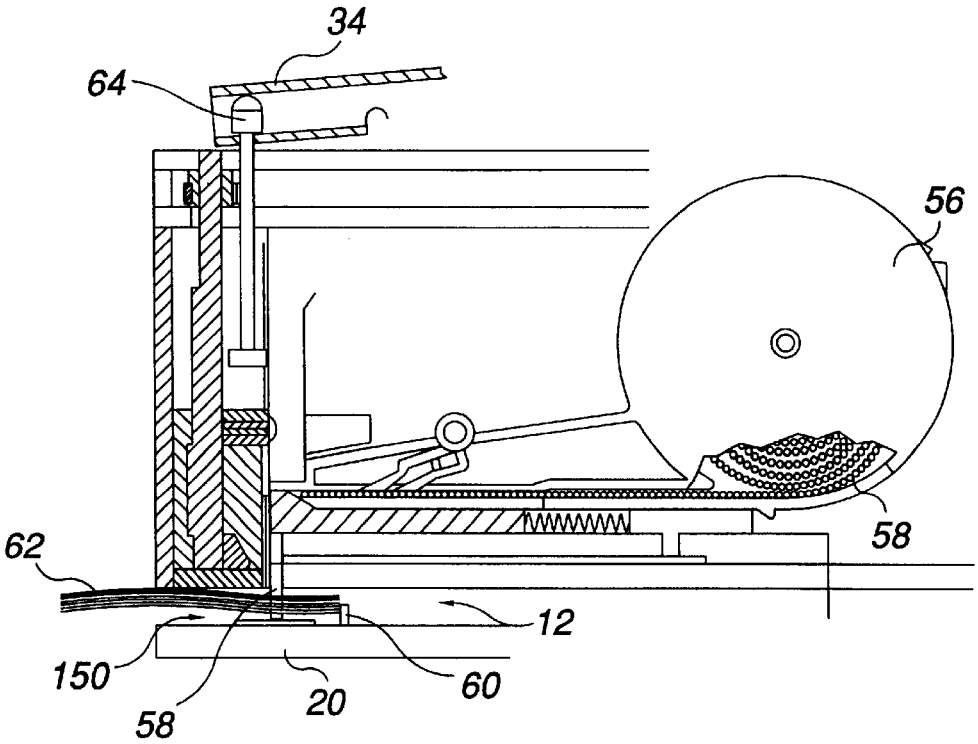

Referring to FIGS. 4 and 5, cartridge 56 is loaded into the stapler. The cartridge preferably has a band of staple blanks 58 in a roll. Other embodiments may employ short stacked strips of staple blanks, as known in the art, or other feed mechanisms to deliver staple blanks to the former/driver mechanism. To staple a stack, as shown in FIG. 5, motor 44 rotates spur gear 46 when a trip switch 60 is pressed by a stack of papers or other material to be stapled 62, and spur gear 46 rotates bull gear 42, causing dumbbell arm-eccentric 40 to turn about shaft 48. As dumbbell arm-eccentric 40 rotates, it causes eccentric plastic disks 50 to turn, causing drive control unit 30 to swing downwardly about axle 16. As the drive control unit 30 moves downwardly, the head 36 is also pivoted downwardly towards the stack 62, and top piece 34 presses against driver actuator 64.

Figure 6A:
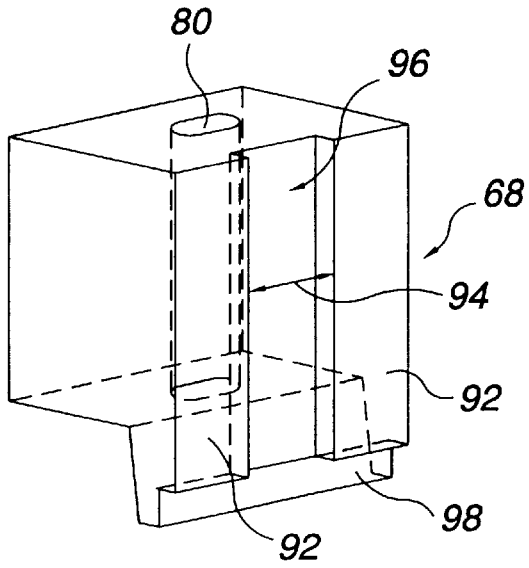
FIG. 6 is an exploded view of portions of a former of the stapler.
Figure 6B:
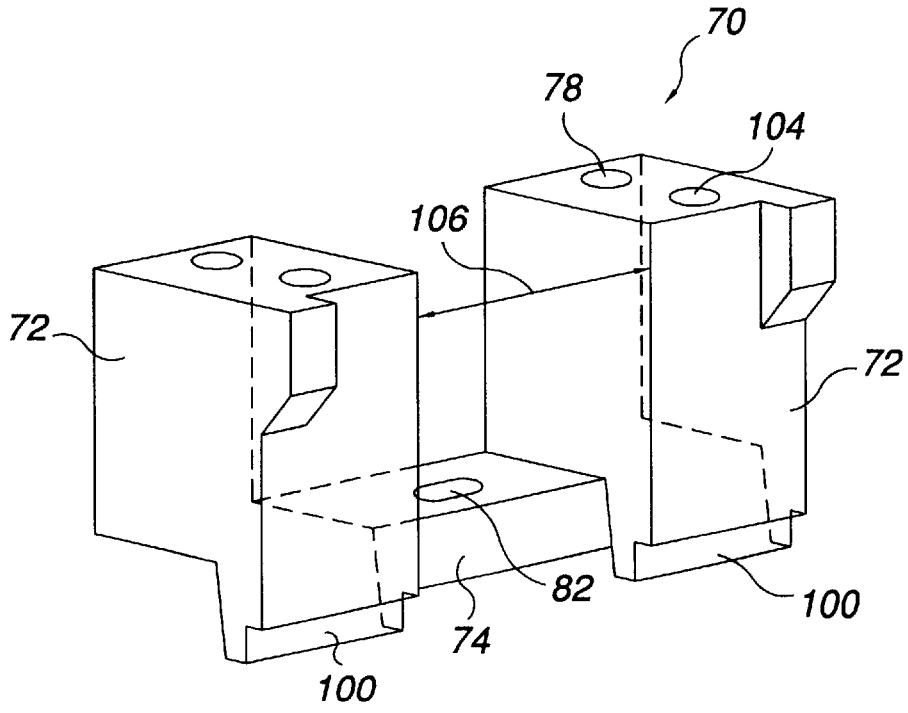
Figure 7A:
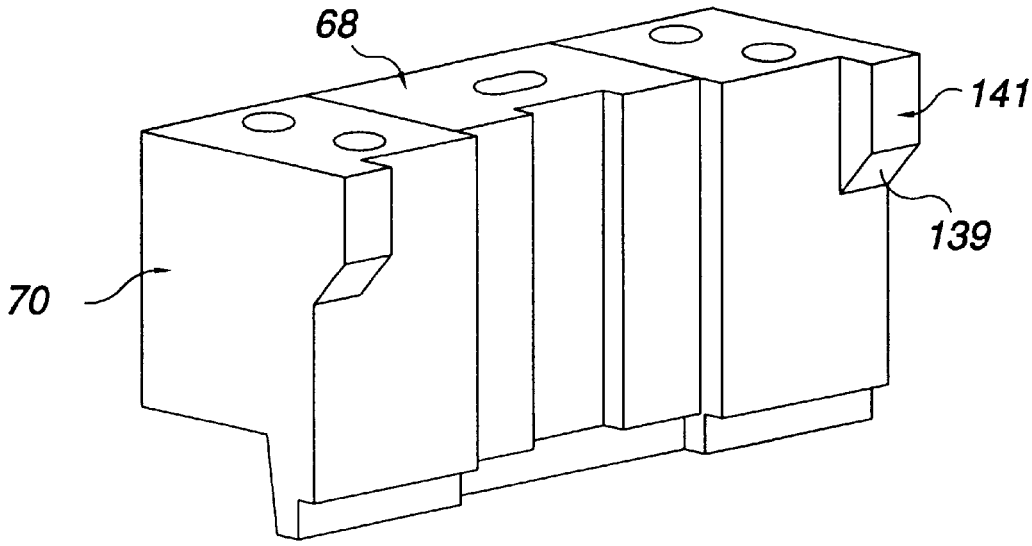
FIG. 7 is a perspective cross-sectional view of former and bending assemblies.
Figure 7B:
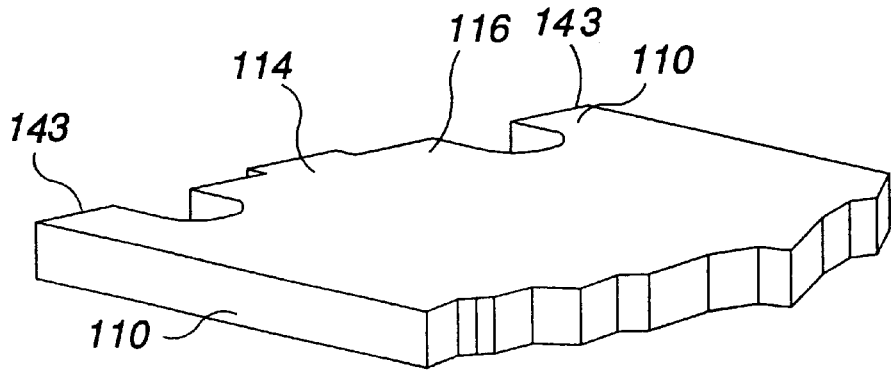
Figure 8:
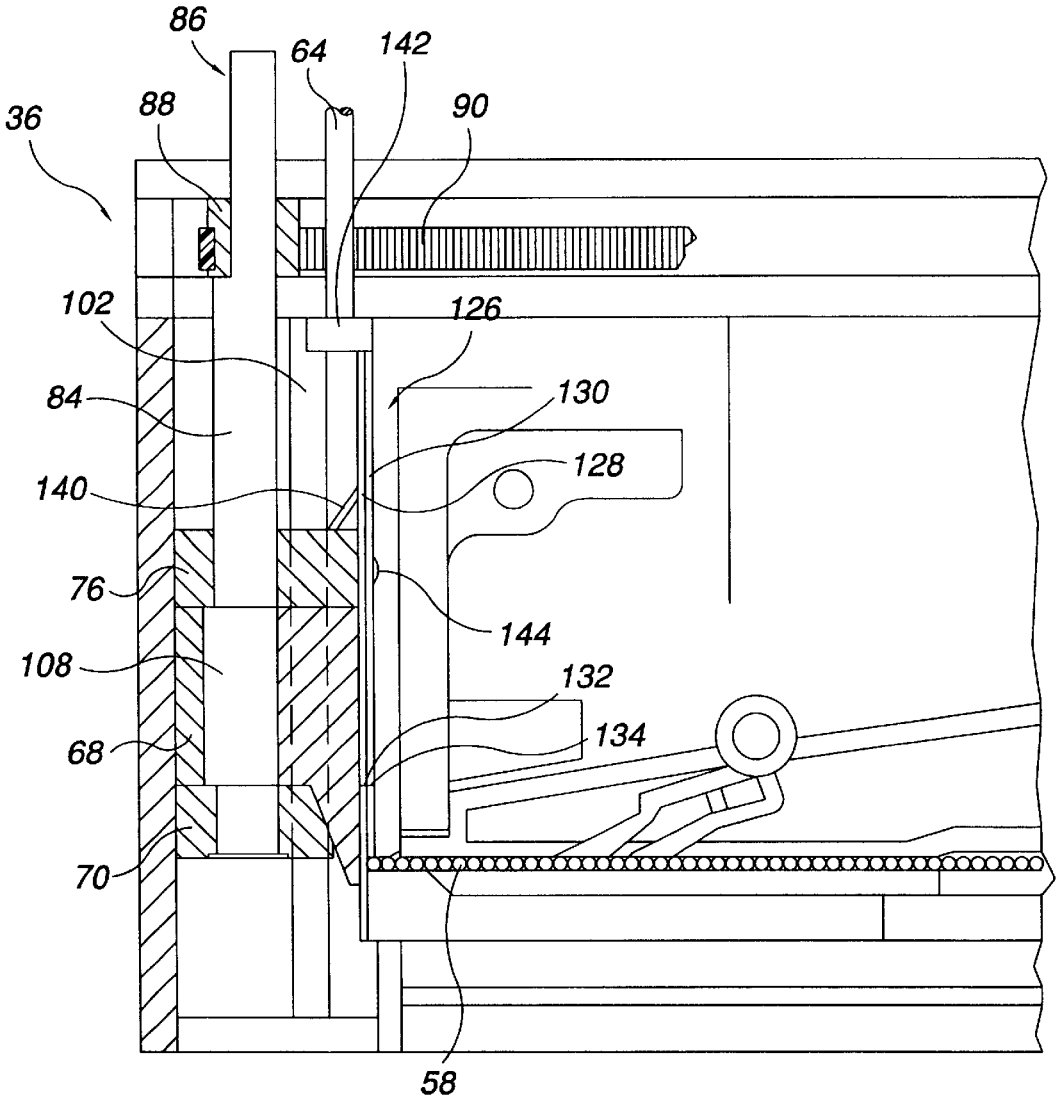
FIG. 8 is an enlarged view of the former/driver assemblies.

The stapler has a former assembly 65 and driver assembly 66, which together comprise a former/driver assembly or mechanism. Referring to FIG. 6, the former assembly preferably includes at least a small former portion 68 and a large former portion 70. The large former portion 70 has two side portions 72 and a base 74 connecting the side portions 72. As shown in FIGS. 6 and 7, the small former portion is disposed against the base 74 and between the side portions 72. As shown in FIG. 8, a coupling plate 76 is disposed above and against the side portions and the small former portion 68, and bolted to side portions 72 through threaded holes 78. The coupling plate 76 and the base 74 of the large former portion 70 couple the large and small former portions to move together substantially in the vertical direction. The small former portion 68, however, is slidably associated with the large former portion 70 for sliding in a fore and aft direction. References in this application to vertical, horizontal fore and rearward directions or the like are made for convenience, although different embodiments may be located in different positions.

The small former 68 has an oblong bore 80 extending vertically therethrough and leading to a circular bore 82 in the base 74 of the large former portion 70. The oblong bore 80 receives a configuration selector shaft 84 extending therethrough, and extending through bore 82 and a bore in the coupling plate 76 aligned therewith. At the upper end of the control shaft is a flattened surface 86 which is engaged within a gear 88, which in turn is driven by belt 90, wherein belt 90 is driven by stepper motor 92.

The small former portion 68 includes two small side portions 92 separated by space 94 at a recess 96. Below the side portions 92 is a blank limit notch 98 which prevents the band of staple blanks 58 from moving past a forming and driving position when they engage against the formers. Similarly, the large former portion 70 has blank limiting notches 100 disclosed beneath the side portions 72, also for positioning the front staple blank 58 at the proper position for forming and driving. Guide shafts 102 extend through bores 104 of the large former portion 70 and through bores aligned therewith in the coupling plate 76. These shafts 102 are secured at both their top and bottom for guiding vertical motion of the former assembly. The side portions 72 of the large former portion 70 are separated by a space 106, which is substantially equal to the width of the small former portion 68.

The former, driver assembly is shown in a configuration for forming and driving staples of a large crown size and a short leg. In this configuration eccentric portion 108 of shaft 84 locates the small former portion 68 rearwardly, to expose space 106 between the large side portions 72.

Figure 9:
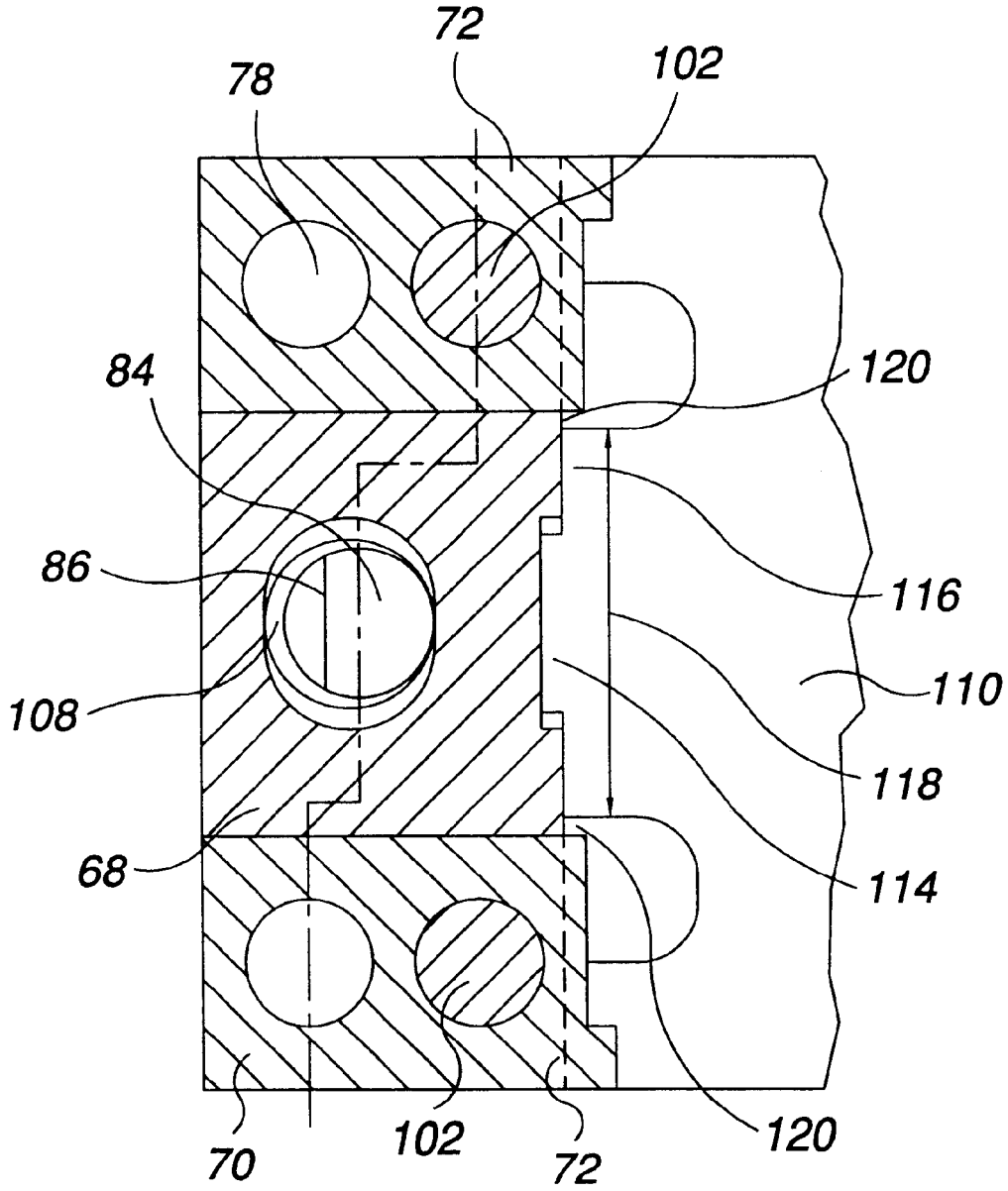
FIGS. 9 and 10 are cross-sectional top views of a portion of the former and including assemblies in different configurations.

A bend plate assembly 110, is preferably constructed as a unitary piece, but may include separate moving portions. Referring to FIGS. 7 and 9, the bend plate 110 preferably includes a small bend portion 114 and a large bend portion 116, which are longitudinally adjacent each other. The leading edges of the bend plate 110 are resiliently biased against the small former portion 68. A width 118 of the large bend portion 116 is smaller than the space 106 by an amount sufficient to provide staple leg clearance spaces 120 between the lateral edges of the large bend portion 116 and the large side portions 72. In this configuration, the leading staple blank 58 is stopped for forward motion at the blank limiting notches 100 of the large side portions 72. A forward feed spring and mechanism 122 and an anti-retract member 124 are preferably provided and function in a manner as will be understood by those of ordinary skill in the art. A suitable mechanism is disclosed in U.S. Pat. No. 4,583,276, which is hereby incorporated by reference. Other advancing mechanisms are also suitable, such as a drive motor directly driving the band or driving other members associated with the band.

Figure 10:
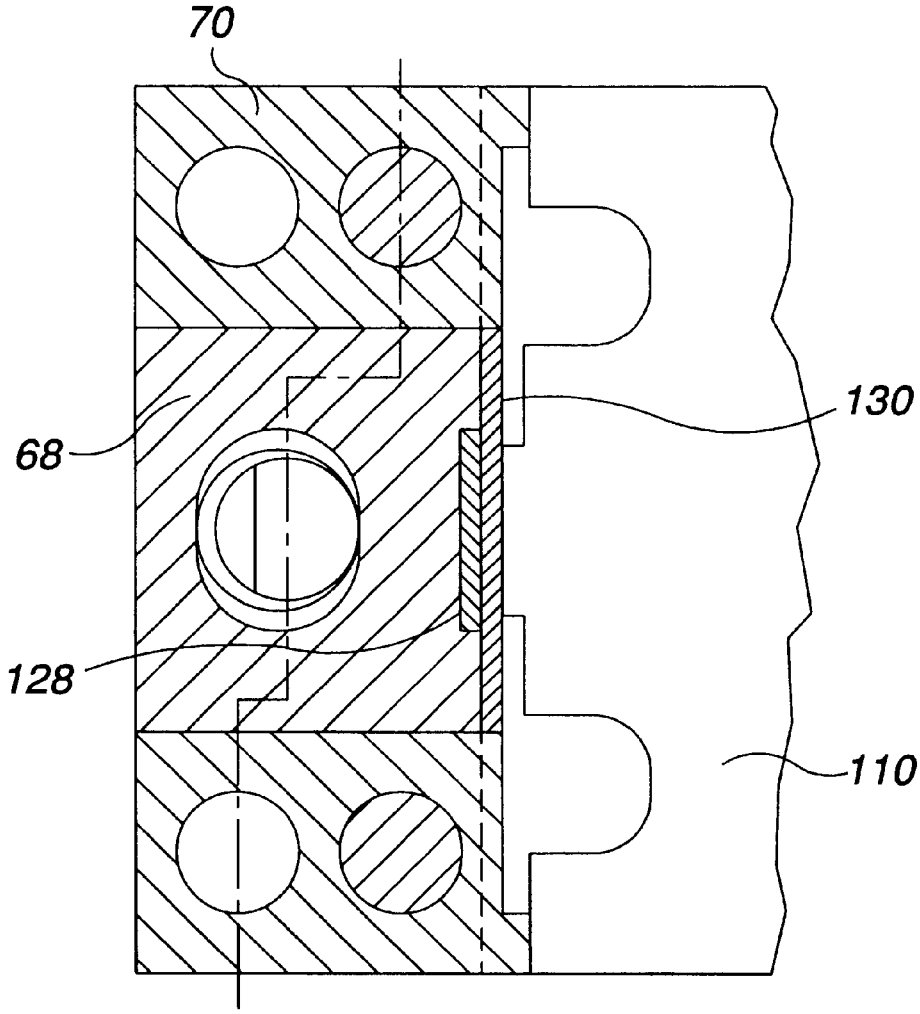
Figure 12:
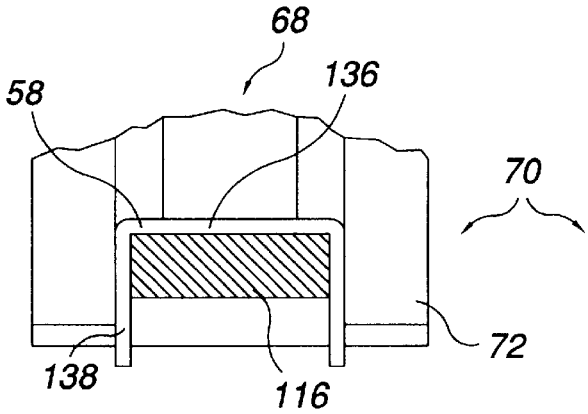
FIGS. 11 and 12 are longitudinal cross-sectional views of the forming process in a large crown configuration.

Referring to FIGS. 4, 8, and 10, a driver assembly 126 preferably includes a small driver blade 128, and a large driver blade 130. The small driver blade is received in the recess 96 of the small former portion and has substantially the same width 94. The large driver blade 130 is preferably in contact with the small driver blade 128 and is disposed against the front surfaces, which face the bend plate assembly 110, of the small forming portion 68. Both drivers preferably move longitudinally together with the small forming portion 68. Each driver blade 128 and 130 has a driving surface 132 and 134. In the large crown configuration, the driving surface 134 of the large driver blade 130 is the operative driving surface, as it is aligned above the leading staple blank, which is disposed over the operative top bend surface of the bend plate 110, which is the top surface of the large bend portion 116. Also, in this configuration the operative former side portions are the side portions 72 of the large former portion 70, as these are also aligned above the leading staple blank 58. Thus the operative side portions are disposed laterally adjacent and on opposite sides of the operative top bend surface. The small side portions 92 and the small bend portion 114 are disposed out of the plane extending through the operative surfaces and the leading staple blank 58.

Figure 11:
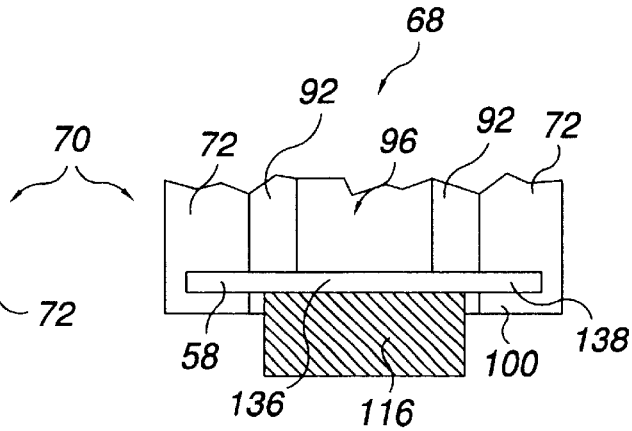

Referring to FIG. 11, the blank limiting notches 98 and 100 preferably extend further in the vertical direction than the diameter of the staple blank 58, more preferably between half and whole diameter beyond the blank 58 in a vertical direction. Generally staple blank cross-sections are oval, with a major axis measuring 0.022 inches and a minor axis measuring 0.018 inches. The most preferred additional vertical space of the blank limiting portions is between 0.01 and 0.015 inches. Large bend portion 116 is shown engaged with a crown portion 136 of the blank 58, and the operative side portions are shown engaged with yet unbent leg portions 138 of the blank 58. When the former assembly is forced down in relation to the bend plate 110, the operative side portions bend the legs down around the sides of the operative large bend portion 116. The small bend plate, being out of plane with the staple blank 58, preferably does not bend the blank 58. The resulting front crown width is less than or equal to the space 106 and more than or equal to the width 118. The formed legs of the staple 58 are disposed in clearances or spaces 120.

Preferably the large former portion 70 also includes ramps 139 of cam portions 141, which are aligned for movement along a path to cam the cam portions 143 of the bend plate 110. When the former assembly passes the vertical point in its travel after which the forming of the legs of the staple blank 58 is complete, the cam portions 141 of the former assembly displace the bend plate 110 out of the driving path of the driver assembly so that the formed staple can be driven into the stack 62. The cam portions may alternatively be located on another element that moves with the former/driver assembly, or the bend plate may simply be moved independently, such as by another motor, a solenoid or other means.

Figure 13:
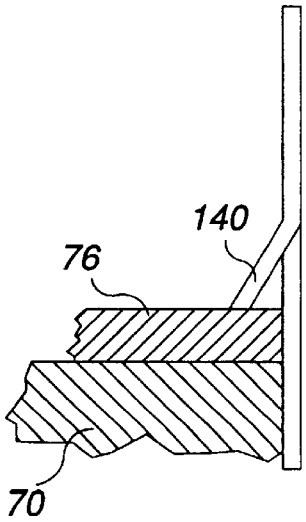
FIG. 13 is a side view of a portion of the former/driver assembly
Figure 15:
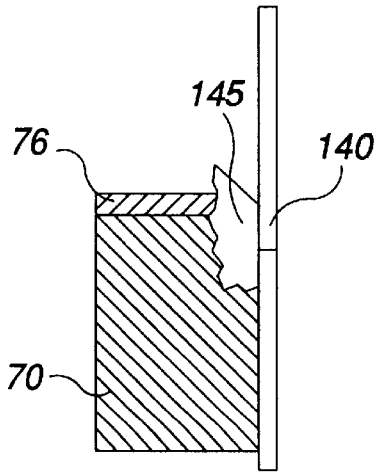
FIG. 15 is a side view thereof after the forming step is complete.
Figure 14:
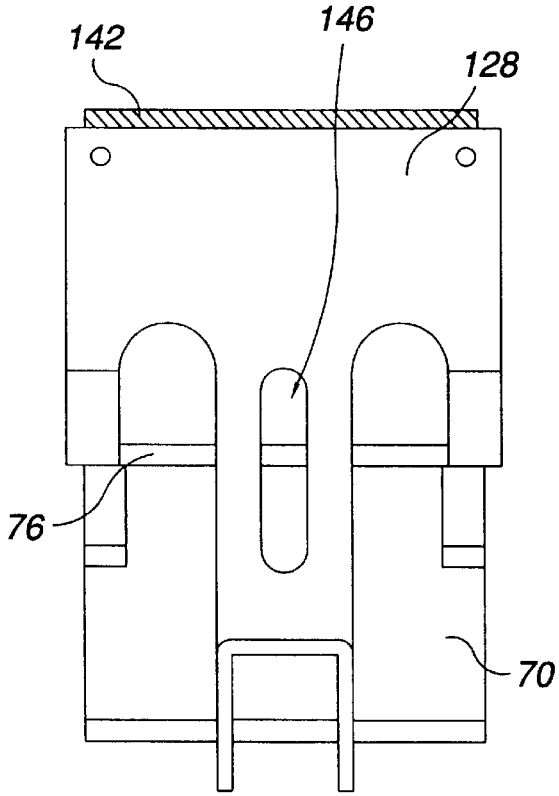
FIG. 14 is a longitudinal view thereof.

Referring to FIGS. 13 and 14, the small driver blade includes legs 140 drivingly engaged against the top of the coupling plate 76. The driver actuator 64, as seen in FIG. 8, has a flat plunger portion 142, which is preferably fixed to the top of the small driver blade. In a large crown configuration, the plunger 142, is also aligned with the large driver blade 130. Thus, when the drive control unit 30 is moved downwardly against the driver actuator 64, the plunger 142 biases both drive blades 128 and 130 downwardly. Legs 140 bias the former assembly downwardly, causing the former assembly to bend the staple legs 58 as described. Once the driver actuator 64, the blades 128 and 130, and the former assembly have been moved vertically to a predetermined location, at a sufficient height such that the legs of the staple have already been formed, the legs 140 of the small blade 128 are cammed back, in a direction towards the blank cartridge 56 by ramps 145, which are preferably secured to the housing, preferably beyond the former assembly, to release the former assembly and allow the driver assembly to continue moving downward separate from the former assembly, as shown in FIG. 15. As shown in FIG. 5, the formed staple 58 is separated from the band of staples and driven through the stack 62. As the bull gear 42 continues to rotate, and lifts the driver actuator 64, button 144, which is fixed to the driver assembly, preferably to the coupling plate 76 and is received in slot 146 of the small blade 128, contacts the edge of the slot 146 and lifts the former assembly backup to the starting position.

Figure 18:
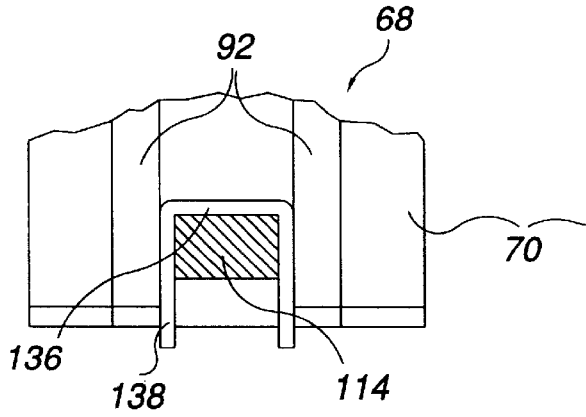
FIGS. 17 and 18 are longitudinal cross-sectional views of the forming process in the small crown configuration.
Figure 17:
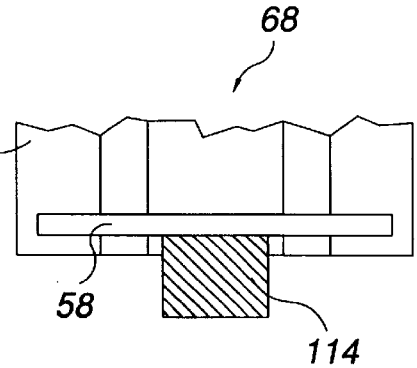
Figure 16:
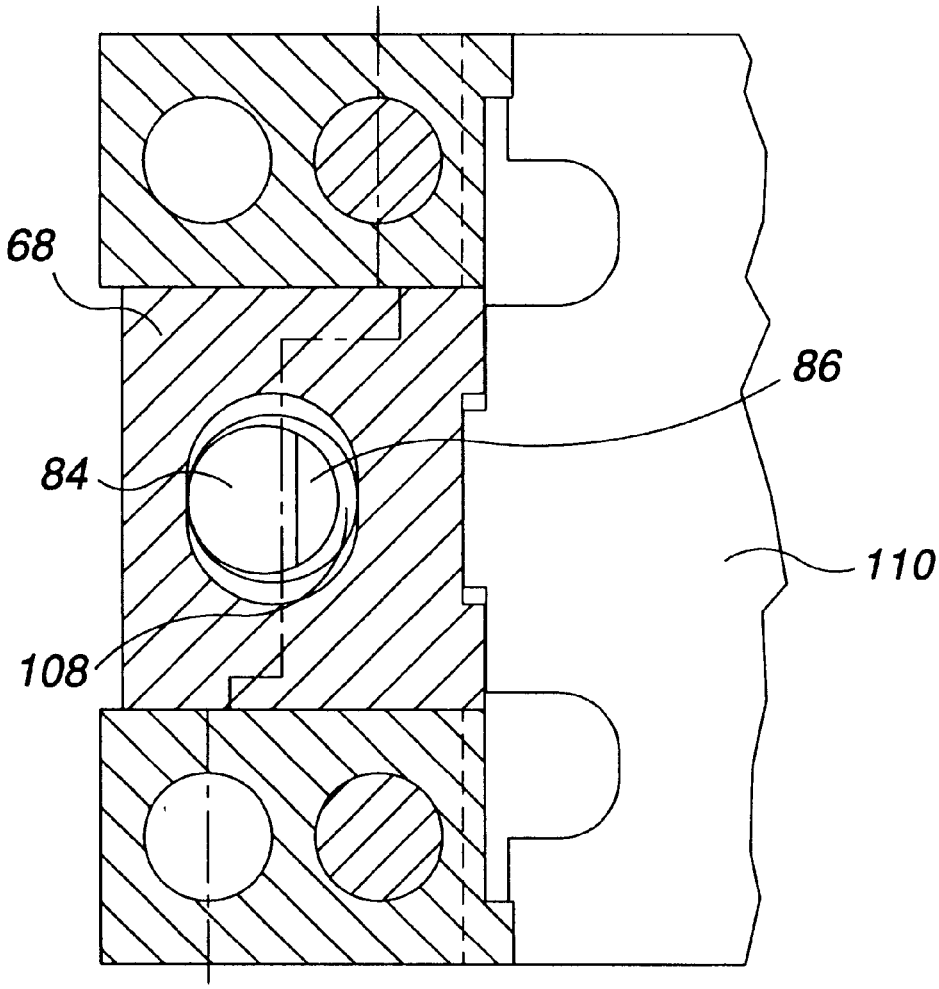
FIG. 16 is a cross-sectional top view of a portion of the former and bending assemblies in a small crown configuration.

A second stapling configuration, corresponding to a smaller crown size and longer staple legs, is selectable by operating the stepper motor to rotate the control shaft 84 preferably by about 180 degrees. As shown in FIG. 16, eccentric portion 108 displaces the small former portion 68 towards the bend plate 110, displacing the bend plate. The front edges of both former portions 68 and 70, are preferably now flush. The blank limiting notches 98 and 100 are now aligned such that the leading staple blank 58 is disposed within the notch and against both large and small former portions 68 and 70. As shown in FIGS. 17 and 18, the operative top surface of the bend plate 110 is the small bend portion 114, and the operative side portions are the small side portions 92. As the formers move down with respect to the bend plate 110, the small side portions 92 engage and bend the leg portions 138 of the staple blank 58 between the bend plate 110 and the side portions 92. As seen from the drawings, the crown width is smaller when the staple is in this configuration, and the leg length is larger. This configuration is better suited for stapling stacks 62 of a larger height than the stacks for which the stapler is best suited in the large crown-configuration.

Figure 19:
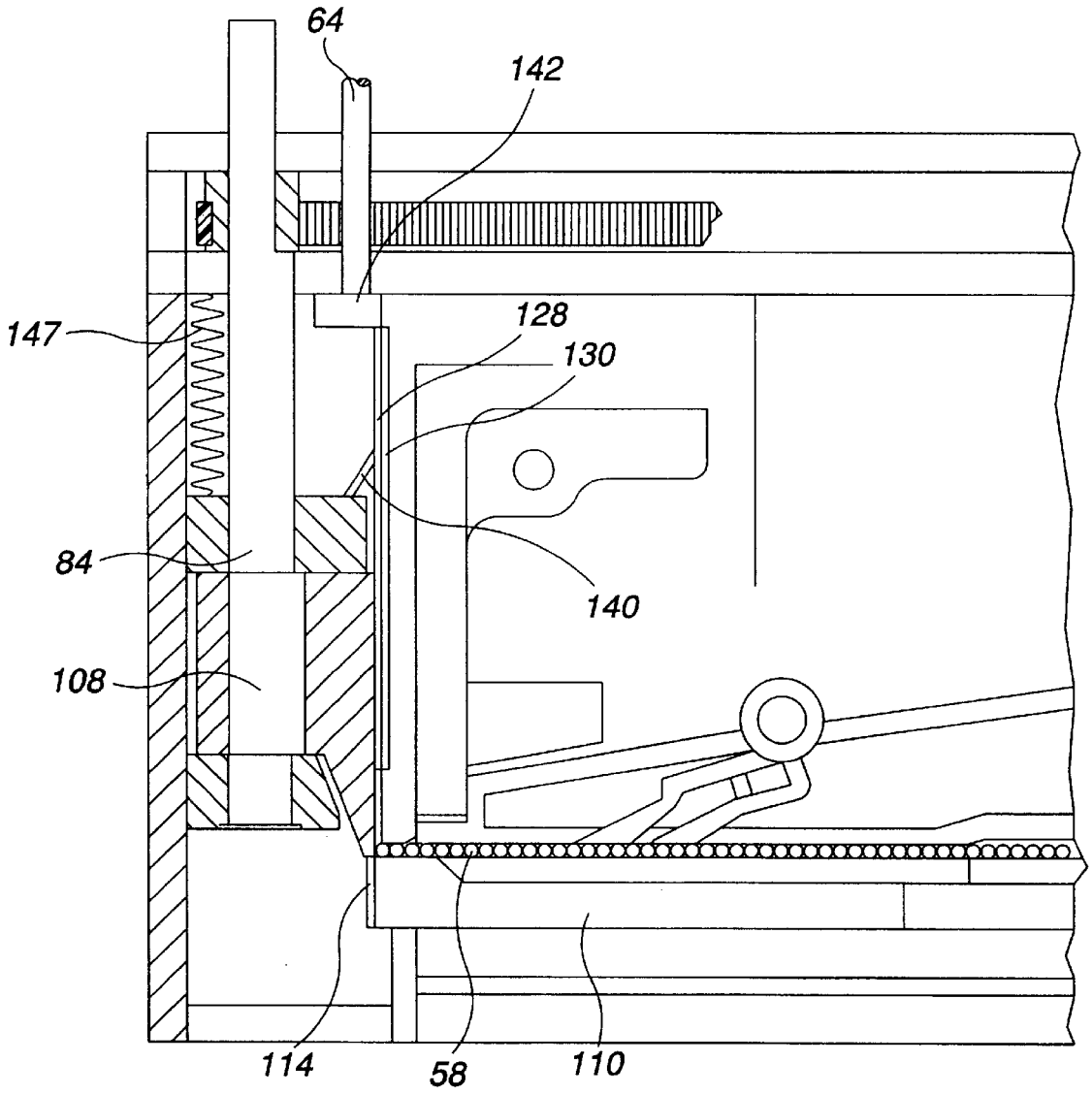
FIG. 19 is an enlarged view of the former/driver assemblies in the small crown configuration.

Referring to FIG. 19, the large driver blade which is now disposed over the second foremost staple blank 58, is no longer aligned with the plunger 142. Thus, when the plunger biases the small driving blade 128 towards the staple blanks 58, the plunger 142 bypasses the large driver blade 130, which preferably remains inoperative during the forming and driving strokes of the stapler. Also shown in FIG. 19 is a spring 147, which may be employed to raise the forming assembly back to the starting position after the forming stroke is complete.

Preferably, the stapler includes a thickness sensor, as known in art, positioned near the stapling zone 150 to determine the height of the stack. If the height of the stack is sensed to be below a predetermined amount, such as below 50 pages, then electronic or electric circuitry preferably operates stepping motor to rotate the control shaft to configure the stapler in the large crown configuration. If the sensor detects a stack height above the predetermined amount, then the stepping motor preferably positions the control shaft to configure the staple in the small crown configuration. U.S. Pat. No. 4,134,672 shows an example of a stack height sensor and electronic control unit. In other embodiments, the shaft 84 may be manually or otherwise rotatable with or without electronics and positionable to select a stack height. Other mechanisms for reconfiguring the stapler may also be employed. For example, the formers and drivers may together or independently be moved by solenoids or separate motors, or by any other actuating mechanism, including manual adjustments made by an operator, to suitably configure the stapler. Additionally, more than two former portions may be employed to form staples to more than two preselected configurations. Also, in an alternative embodiment, the plunger 142 may be associated with another cam on the control shaft 84 to amplify the longitudinal movement thereof.

Figure 20:
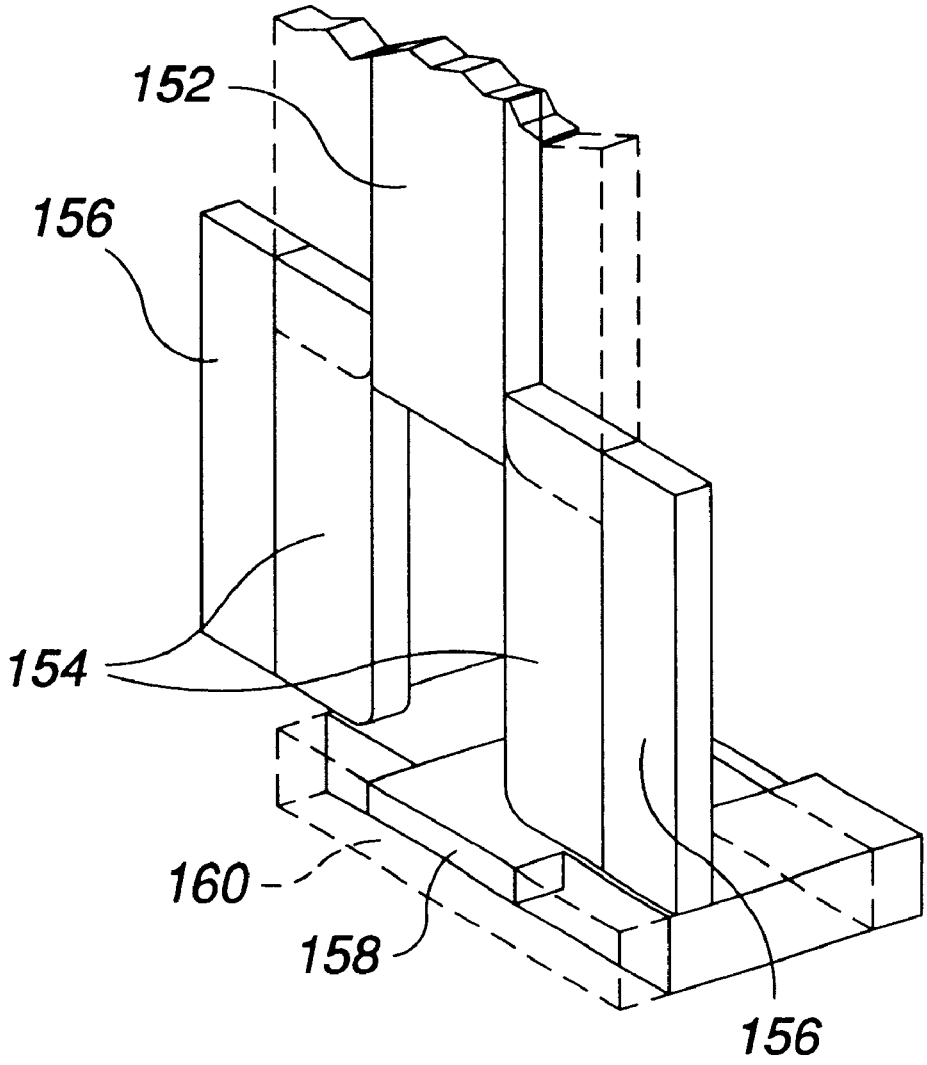
FIG. 20 is a perspective view of an alternative embodiment of the former/driver assembly.

An alternative embodiment of the former/driver mechanism is shown in FIG. 20. This embodiment is also configured for forming staples into one of two crown sizes. The stapler includes central and side blades 152 and 154 and outside blades 156.

The bend plate assembly includes a small width, preferably fixed portion 158, and a large width portion 160. Preferably the large portion 160 is slidable longitudinally with respect to the small portion 158, but the small and large portions 158 and 160 may be fixed together similar to the bend plate 110 in the first preferred embodiment described.

The positions of the blades 152, 154, and 156 in the small crown configuration are shown in solid lines, as are the positions of the blades 158 and 160. In this configuration, the former assembly includes plates 156 and 154, which move together downwardly with respect to the operative small portion 158 of the bend plate, on which lies the staple blank (not shown). Once the blank is formed with the staple legs bent between the blades 154 and the small bend portion 158, blade 152, which functions as a driver, descends upon the formed staple as the bend plate is moved longitudinally out of the path of the drive 152 to drive the staple through a stack. In this configuration of the former/driver mechanism, the driver assembly comprises the blade 152.

The preferred starting positions of the blades in the large crown configuration are shown in dashed lines in FIG. 20. The large bend portion 160 is positioned beneath the blades in this configuration, and the driver assembly comprises blades 152 and 154 which start elevated with the respect to the outer blades 156. The former assembly in this configuration now comprises only blades 156, which descend laterally adjacent the large bend portion 160 to bend the legs at a different location along bend plate, forming a finished staple with a larger crown size. The individual blades may be moved separately such as by solenoids, a linkage mechanism, motors with lead screws, or by any other suitable mechanism, and the same is the case for the bend plate assembly. Also, the blades shown can be made with other shapes that are not necessarily flat, and can include additional blades or pairs of blades for forming staples with additional crown sizes.

Figure 21:
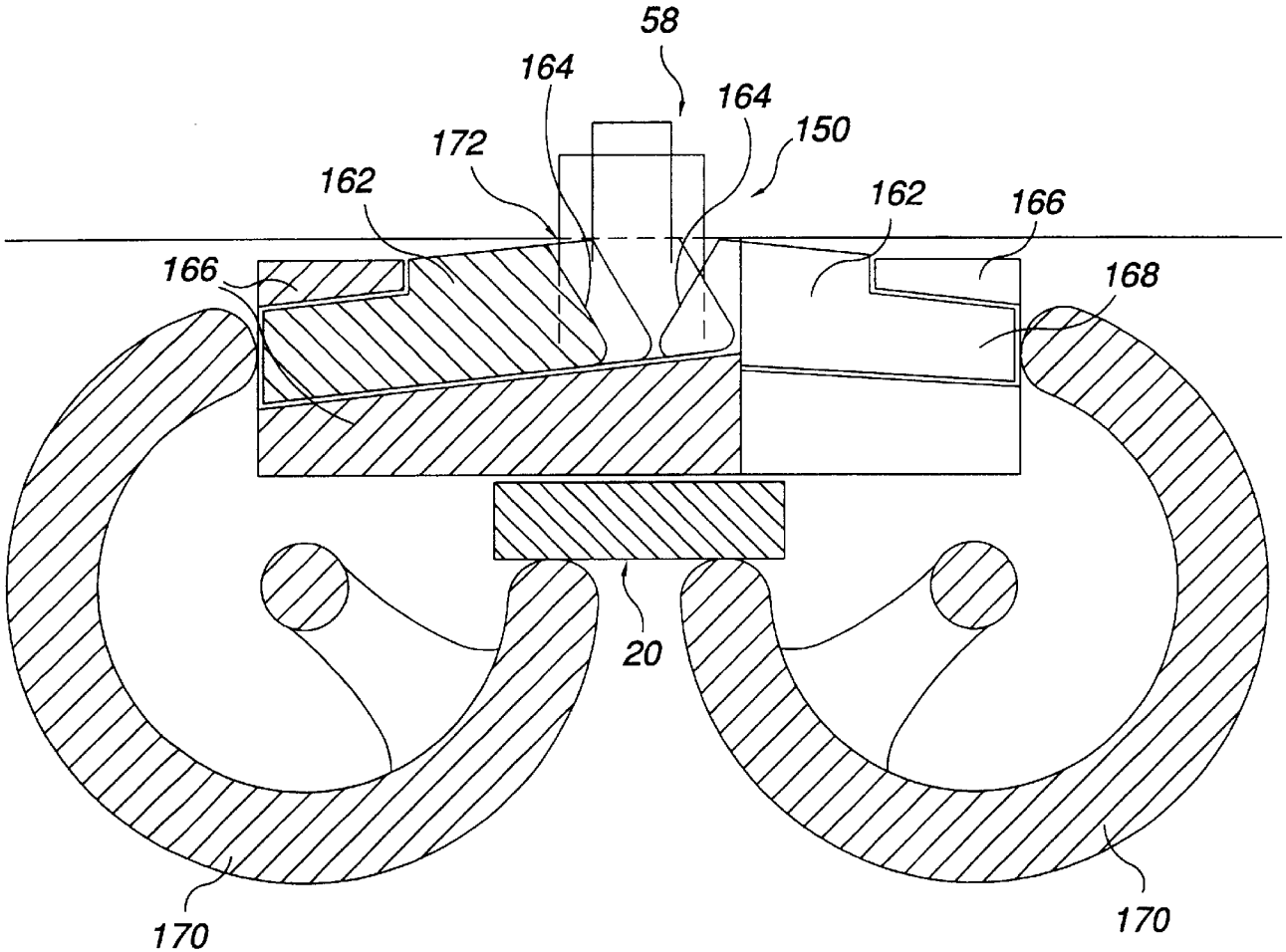
FIG. 21 is a front cross-sectional view of a preferred embodiment of a clinching mechanism of the stapler constructed according to the present invention.

Referring to FIG. 21, the preferred clinching mechanism includes clinching members 162 with clinching surfaces 164. The clinching surfaces 164 are preferably disposed at an angle to the vertical, and face the stapling zone. The clinching members 162 are preferably movable along a clinching path that intersects the position in which the staple legs 138 extend through the stack to be stapled, regardless of the crown size. The clinching surfaces 164 are spaced laterally at least by the maximum crown width of a staple for which the stapler is configured to employ.

The clinching members are preferably mounted in housings 166, which include a passage configured to direct the clinching member 162 along the clinching path. Most preferably each clinching member 162 includes a guided portion 168 which is guided by and received within the housing 166. The preferred clinching path is linear, as shown in FIG. 21, but other paths may also be employed. Preferably the clinching path is selected such that regardless of the position or separation of the staple legs, the clinching surfaces 164, contact the legs initially substantially at a same contact angle, or an angle within a preferred range, regardless of the crown size of the staple.

In this embodiment, the clinching members 162 are activated when cam pins 26 cammingly engage and displace cam lobes 24 to rotate or otherwise move the kicker plate 20 downwardly. As plate 20 engages table linkages 170, which are preferably pivotably associated with frame 12, linkages 170 are rotated against the clinching members 162 to displace the clinching member 162 along the clinching path, thereby clinching the bottom portions of the staple legs that protrude into an anvil area 172 beneath the stack. Other means of actuating the clinching members, such as solenoids, or any of the parts of the stapler may also be actuated by a controlling electronic or electric circuitry. Additionally the clinching members 162 may be linked to the linkage 170, and linkage 170 may be linked to the plate 20, such that when the kicker plate 20 is moved back in the upwards direction, it pulls the linkage 170 and the clinching members 162 back to their starting positions in order to receive the legs of the next staple to be stapled. In this embodiment the clinching members 162 are thus moveable in a clinching direction along the clinching path towards the staple legs for bending the legs generally orthogonally to the clinching direction.

Figure 22:
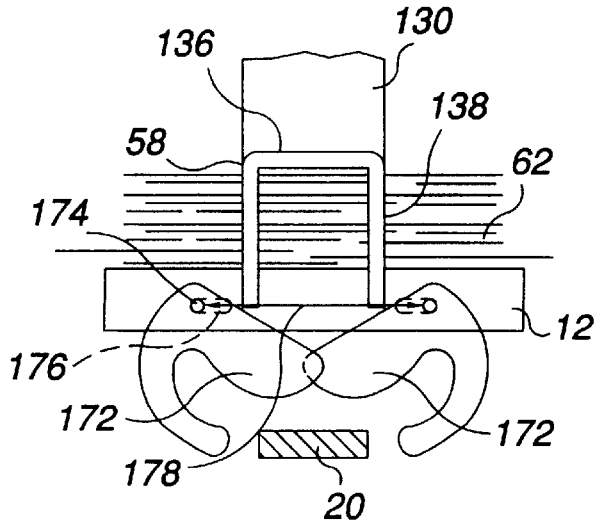
FIGS. 22 and 23 are partial front views of an alternative embodiment of the clinching mechanism in large and small crown configurations, respectively.
Figure 23:
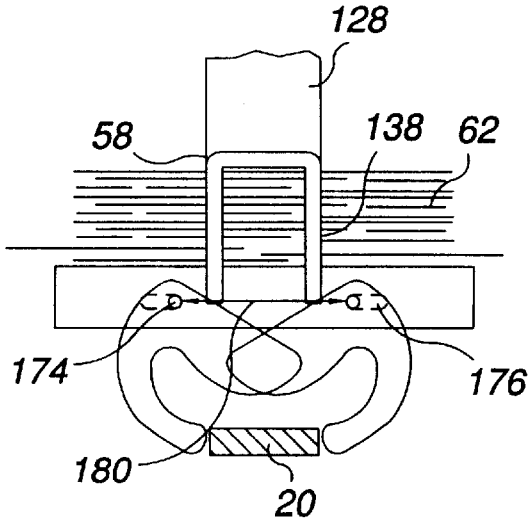
Figure 24:
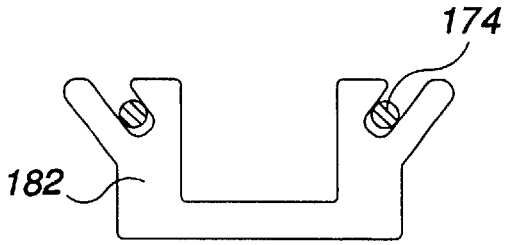
FIG. 24 is a partial front view of a pivot-positioning mechanism thereof.

In the embodiment of the clinching mechanism shown in FIGS. 22–24, the clinching members comprise clinching rings 172 which are actuatable by the kicker plate 20. The clinching wings 172 are preferably mounted on pivots 174 which are slidably received in slots 176 of a portion of the stapler, such as the frame 12.

In FIG. 22, the clinching wings 172 are positioned with pivots 174 and corresponding pivots points spaced by a wide distance 178. Thus the legs of a staple having a large crown 136 can be contacted at the selected and most effective angle of initial contact as the clinching wings pivot against the legs 138. In FIG. 23, the pivots 174 have been displaced towards each other such that they are separated by a distance 180, which is smaller than distance 178, to initially contact the longer and closer legs 138 of a staple with a smaller crown size at substantially the same angle as illustrated in FIG. 22, but within an acceptable angular range therefrom.

Referring to FIG. 24, pivot control member 182 is preferably provided, and is movable in a vertical direction in order to position the pivots 174 laterally within the slots 176. In the embodiment of FIGS. 22 and 23, the clinching path is generally arcuate with respect to the stapling zone and the staple legs 138. The path is thus shiftable by shifting the pivot points.

One of ordinary skill in the art can envision numerous variations and modifications. All of these modifications are contemplated by the true spirit and scope of the following claims.

What is claimed is:

1. A staple forming mechanism having at least first and second configurations, the forming mechanism comprising:

(a) a bend plate assembly having a top bend surface engageable with a crown portion of a staple, the top bend surface having:

(i) a first surface width in the first configuration, and (ii) a second surface width greater than the first width in the second configuration; and (b) a former assembly having at least two operative side portions disposed laterally adjacent and on opposite sides of the top bend surface and engageable with leg portions of the staple, the operative side portions being separated by a former space that has:

(i) a first former width in the first configuration, and (ii) a second former width greater than the first former width in the second configuration;

wherein the operative side portions and the bend plate are operatively associated and movable to a forming position with the bend plate disposed in the former space such that the operative side portions bend legs of a staple about the bend plate to produce first or second crown widths of the staple corresponding to the first or second widths when in the first or second configurations, respectively.

2. The forming mechanism of claim 1, wherein the former assembly includes:

(a) a first former portion including at least one first side portion; and (b) a second former portion including at least one second side portion;

wherein the first and second former portions are selectively positionable, in the first and second configurations respectively, laterally adjacent the bend surface opposite from one of the operative side portions to define the other of the operative side portions.

3. The forming mechanism of claim 2, wherein:

(a) the at least one first side portion includes two first side portions spaced by the first former width and defining the operative side portions in the first configuration; and (b) the at least one second side portion includes two second side portions separated by the second former width and defining the operative side portions in the second configuration.

4. The forming mechanism of claim 3, wherein the first side portions are disposed laterally between the second side portions.

5. The forming mechanism of claim 4, wherein in the first configuration, both the first and second side portions are disposed in alignment with the top bend surface.

6. The forming mechanism of claim 4, wherein the first and second former portions are coupled to move together substantially in the vertical direction.

7. A stapler comprising:

(a) the forming mechanism of claim 3;

(b) a driver including first and second driver portions having driving surfaces of first and second driver widths, respectively, for driving the staples of first and second crown sizes in the first and second configurations, respectively, into a stack disposed beneath the driver, wherein the first former portion defines a recess between the first forming sides, the first driver portion is disposed in said recess, and the driver is associated with at least one of the former portions for movement therewith between the first and second configurations.

8. The forming mechanism of claim 2, further comprising a cam rotatably associated with at least one of the former portions, the at least one of the former portions being cammable by the cam between a location corresponding to the first configuration and another location corresponding to the second configuration.

9. The forming mechanism of claim 1, wherein:

(a) the bend plate assembly includes:

(i) a first plate portion having the first width; and (ii) a second plate portion having the second width;

(b) wherein the bend plate assembly is movably associated with the former assembly such that the first and second plate portions are selectively positionable in a bending position between and adjacent the operative side portions in the first and second configurations, respectively, such that the one of the first and second plate portions positioned in the bending position defines the top surface.

10. The forming mechanism of claim 9, wherein:

(a) the former assembly includes:

(i) a first former portion including at least one first side portion, and (ii) a second former portion including at least one second side portion, wherein the first and second former portions are selectively positionable, in the first and second configurations respectively, laterally adjacent the bend surface opposite from one of the operative side portions to define the other of the operative side portions; and (b) the bend plate assembly is resiliently biased against at least one of the former portions such that movement thereof between the first and second configurations causes movement of the bend plate assembly therebetween.

11. The forming mechanism of claim 10, wherein:

(a) the at least one first side portion includes two first side portions spaced by the first former width and defining the operative side portions in the first configuration, the first former portion defining a recess between the first side portions; and (b) the bend plate being resiliently biased such that the first plate portion is received within the recess and the second plate portion is in contact with the side portions.

12. The forming mechanism of claim 9, wherein the first and second plate portions are of unitary construction.

13. A stapler having at least first and second configurations, the stapler comprising:

(a) a staple former capable of accommodating and forming staples having crowns of at least first and second crown sizes; and (b) a driver having a driving surface movable against at least one of the staples in a driving direction for driving the at least one of the staples into a stack disposed therebeneath, the driving surface having:

(i) a first driver width in the first configuration for driving the staples of the first crown size into a stack disposed beneath the staples, and (ii) a second driver width wider than the first driver width in the second configuration for driving the staples of the second crown size into a stack disposed beneath the staples.

14. The stapler of claim 13, wherein the driver comprises:

(a) a first driver blade having the first driver width and defining the first configuration; and (b) a second driver blade having the second driver width and defining the second configuration.

15. The stapler of claim 14, further comprising a driver actuator drivingly associated with the first and second driver blades for coupled movement in the driving direction in one of the configurations, and drivingly associated with only one of the driver blades for movement in the driving direction in the other configuration.

16. A stapler for stapling staples of at least first and second crown sizes, the stapler comprising:

(a) a frame;

(b) a driver associated with the frame and configured for driving the staples into a stack in a stapling zone; and (c) a clinching assembly mounted to the frame and including:

(i) at least one clinching member having a clinching surface positioned with respect to a leg of one of the staples and movable along a clinching path to engage the leg at substantially a same contact angle regardless of whether the staple is of the first or second crown size.

17. The stapler of claim 16, wherein the at least one clinching member includes at least one clinching wing pivotably mounted to the frame about a pivot point such that the clinching path is generally arcuate with respect to the stapling zone, the path being movable with respect to the stapling zone between predetermined positions corresponding to the crown size of the staple to maintain said contact angle.

18. The stapler of claim 17, wherein:

(a) the frame defines at least one slot;

(b) the at least one clinching wing includes a pivot that is pivotably connected to the frame; and (c) the pivot of the each at least one clinching wing is pivotably mounted within the at least one slot slidably between the predetermined positions.

19. The stapler of claim 16, wherein:

(a) the clinching surface is movable in a clinching direction towards the leg for bending the leg generally orthogonally to the clinching direction.

20. The stapler of claim 19, wherein the at least one clinching member is slidably associated to the frame for generally linear movement along the clinching direction.

21. The stapler of claim 20, further comprising a rotating member that drives the generally linear movement of the at least one clinching member.

22. The stapler of claim 16, wherein the at least one clinching member includes two clinching members, wherein one of the clinching members is pivotable about a first pivot point, and the other of the clinching members is pivotable about a second pivot point, and wherein the first and second pivot points are moveable with respect to one another.

23. The stapler of claim 22, wherein the first and second pivot points are moveable with respect to one another in a direction that is substantially perpendicular to a driving direction of the driver.

* * * * *